US010481520B1

(12) United States Patent
Ohshima

(10) Patent No.: US 10,481,520 B1
(45) Date of Patent: Nov. 19, 2019

(54) IMAGE FORMING APPARATUS AND CONTROL METHOD OF IMAGE FORMING APPARATUS

(71) Applicant: TOSHIBA TEC KABUSHIKI KAISHA, Shinagawa-ku, Tokyo (JP)

(72) Inventor: Masami Ohshima, Nagaizumi Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/155,973

(22) Filed: Oct. 10, 2018

(51) Int. Cl.
*G03G 15/04* (2006.01)
*G03G 15/043* (2006.01)
*G03G 15/00* (2006.01)

(52) U.S. Cl.
CPC ..... *G03G 15/043* (2013.01); *G03G 15/50* (2013.01)

(58) Field of Classification Search
CPC ..... G03G 15/043; G03G 15/50; G03G 21/14; G03G 2215/00025; G03G 2215/04; G03G 2215/0407
See application file for complete search history.

(56) References Cited

U.S. PATENT DOCUMENTS 6,604,151 B1 8/2003 Date et al.
2005/0271410 A1* 12/2005 Namizuka ..... G06F 1/32 399/75
2008/0239380 A1* 10/2008 Takahashi ..... G03G 15/5004 358/1.15
2011/0109920 A1* 5/2011 Nakase ..... G03G 15/5008 358/1.5
2016/0077460 A1* 3/2016 Miyadera ..... G03G 15/043 358/524

* cited by examiner

*Primary Examiner* — Sophia S Chen
(74) *Attorney, Agent, or Firm* — Amin, Turocy & Watson LLP

(57) ABSTRACT

According to one embodiment, an image forming apparatus includes a storage unit, a first processor, a second processor, and an arbitration unit. The storage unit stores control information related to at least one parameter of light emission of each of a plurality of light emitting elements that irradiate a photoconductor with light. The first processor accesses the storage unit. The second processor accesses the storage unit and accesses faster than the first processor. The arbitration unit controls the second processor to access the storage unit in a first period during which predetermined processing is performed. In a second period other than the first period, the arbitration unit controls the first processor to access the storage unit.

20 Claims, 8 Drawing Sheets

IMAGE FORMING APPARATUS AND CONTROL METHOD OF IMAGE FORMING APPARATUS

FIELD

Embodiments described herein relate generally to an image forming apparatus and a control method of an image forming apparatus.

BACKGROUND

An electrophotographic image forming apparatus using a light emitting diode as a light source for exposing a photoconductor is known. The light emitting diode is, for example, an electronic device, such as an organic light emitting diode (OLED) or a light emitting diode (LED).

Each light emitting element of the light emitting diode varies in the amount of light emitted. In order to reduce the variation in the amount of light emitted from each light emitting element, a technology for adjusting the amount of light emitted from each element is known. In the technology, a register for holding the parameters of the light emitting element is provided. Since the number of light emitting elements provided in the image forming apparatus is large, the data amount of the parameter also increases. Therefore, when writing or reading the parameter to and out from the register that holds each parameter is performed, it takes a long time to access the register. Accordingly, there is a problem that the processing time becomes disadvantageously long.

DETAILED DESCRIPTION

Figure 1:
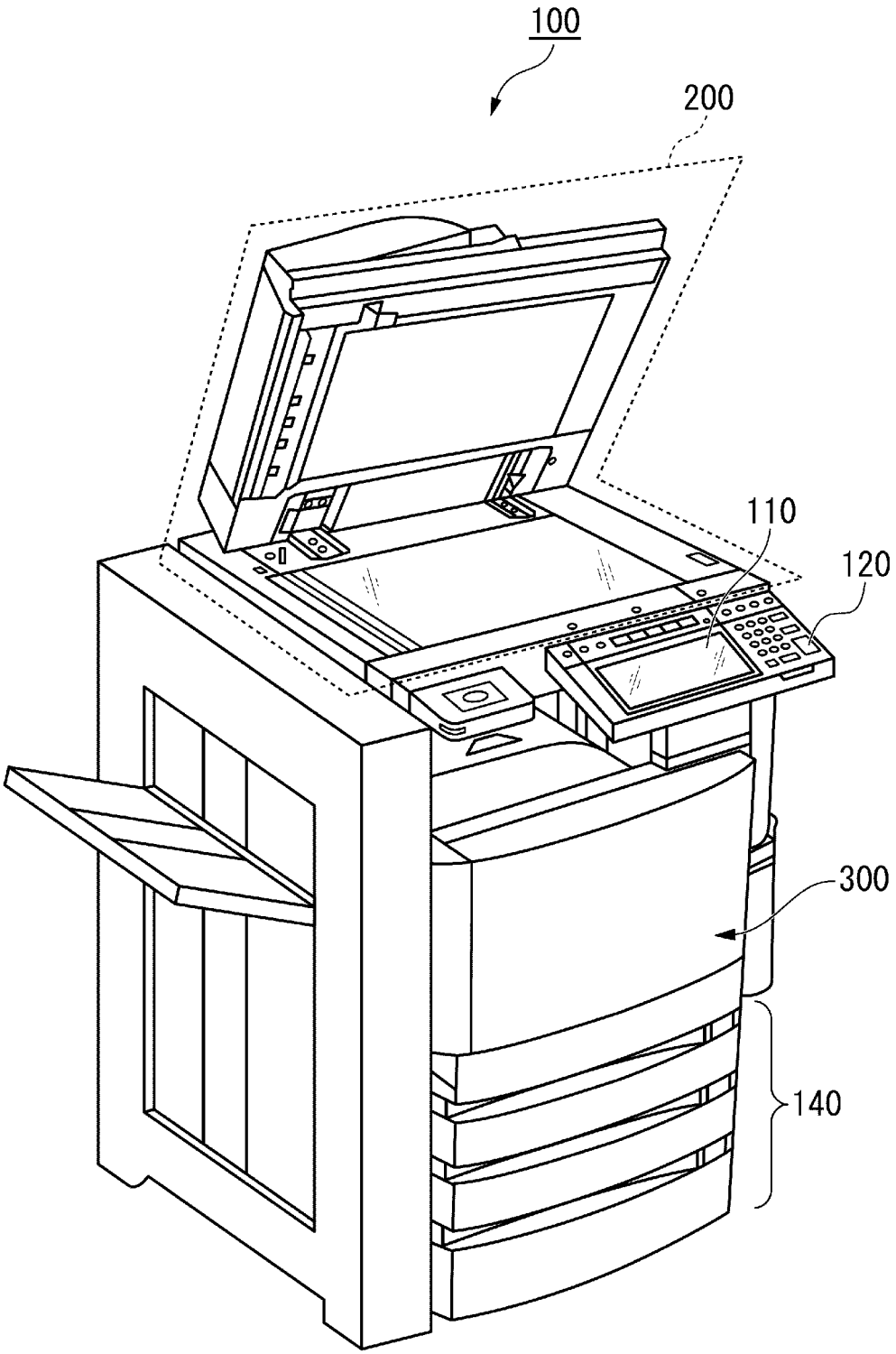
FIG. 1 is an external view illustrating an overall configuration example of an image forming apparatus of an embodiment.

In general, according to one embodiment, an image forming apparatus includes a storage unit, a first processor, a second processor, and an arbitration unit. The storage unit stores control information related to at least one parameter of light emission of each of a plurality of light emitting elements that irradiate a photoconductor with light. The first processor accesses the storage unit. The second processor accesses the storage unit and accesses faster than the first processor. The arbitration unit controls the second processor to access the storage unit in a first period during which predetermined processing is performed. The arbitration unit controls the first processor to access the storage unit in a second period other than the first period.

Hereinafter, the image forming apparatus of the embodiment will be described with reference to the drawings. In addition, in the following drawings, the same reference numerals will be given to the same configurations.

FIG. 1 is an external view illustrating an overall configuration example of an image forming apparatus 100 of the embodiment. The image forming apparatus 100 is, for example, a compound machine. The image forming apparatus 100 includes a display 110, a control panel 120, a printer unit 300, a sheet accommodating unit 140, and a scanner unit 200. In addition, the printer unit 300 of the image forming apparatus 100 may be an electrophotographic type device that fixes a toner image or an ink jet type device.

The image forming apparatus 100 forms an image on a sheet using a developer, such as a toner. The sheet is, for example, a paper sheet or a label paper sheet. The sheet may be anything as long as the image forming apparatus 100 can form an image on the surface thereof.

The display 110 is an image display device, such as a liquid crystal display or an organic electro luminescence (EL) display. The display 110 displays various types of information related to the image forming apparatus 100. The control panel 120 includes a plurality of buttons.

The control panel 120 receives an operation of a user. The control panel 120 outputs a signal that corresponds to the operation performed by the user to a control unit of the image forming apparatus 100. In addition, the display 110 and the control panel 120 maybe configured as an integral touch panel. The printer unit 300 forms the image on the sheet based on the image data generated by the scanner unit 200 or the image data received via a communication path. The printer unit 300 forms the image by the following processing, for example.

The printer unit 300 forms an electrostatic latent image on the photoconductive drum based on the image data. The printer unit 300 forms a visible image by adhering a developer, such as toner, to the electrostatic latent image. The toner includes toner of primary colors, such as yellow, magenta, cyan, and black, for example. Hereinafter, yellow is also referred to as "Y". Hereinafter, magenta is also referred to as "M". Hereinafter, cyan is also referred to as "C". Hereinafter, black is also referred to as "K".

The printer unit 300 transfers the visible image onto the sheet. The printer unit 300 fixes the visible image on the sheet by heating and pressurizing the sheet. The sheet on which the image is formed by a fixing unit is discharged to the outside of the device from a sheet discharge unit.

The sheet accommodating unit 140 accommodates the sheet used for image formation in the printer unit 300. In addition, the sheet on which the image is formed may be the sheet accommodated in the sheet accommodating unit 140 or may be a sheet pointed by hand.

The scanner unit 200 reads the image to be read as light and shade of light and converts the image into image data, such as RGB values. The scanner unit 200 records the image data of the read image. The recorded image data may be transmitted to another information processing device via a network. The recorded image data may be formed on the sheet by the printer unit 300.

Figure 2:
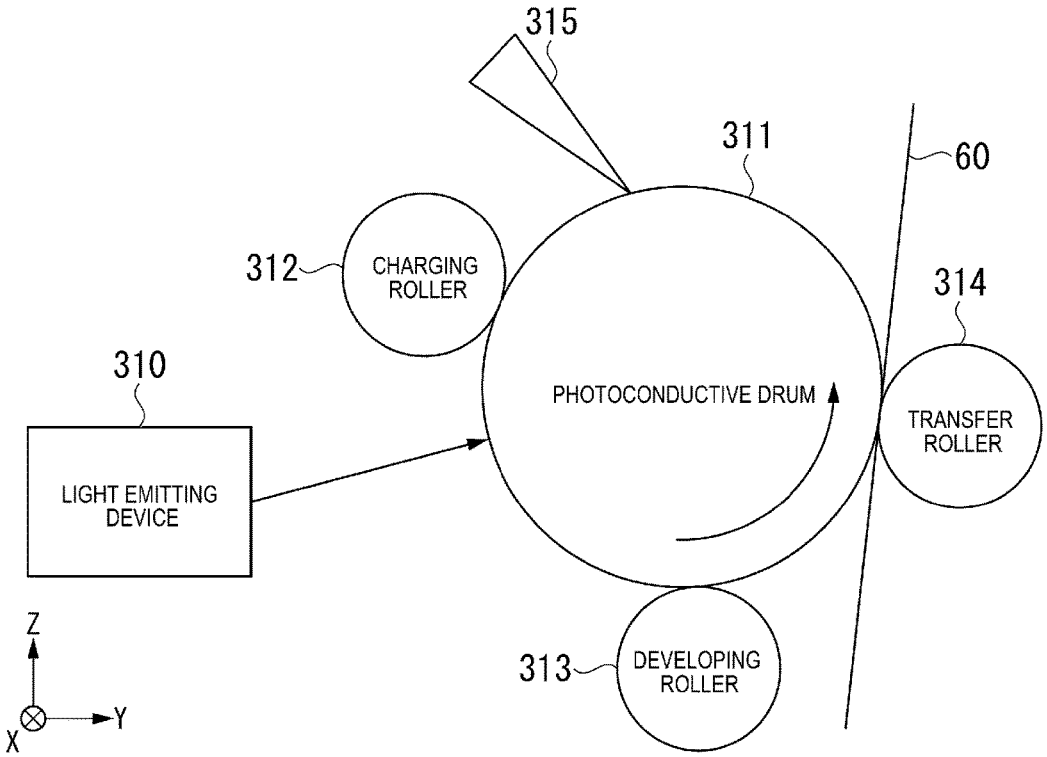
FIG. 2 is a view illustrating an example of a configuration of a printer unit of the embodiment.

FIG. 2 is a view illustrating an example of a configuration of the printer unit 300 of the embodiment. FIG. 2 exemplifies a configuration of an image forming unit of one color among Y, M, C, and K colors. In other words, the printer unit 300 includes four sets of the configuration of the image forming unit illustrated in FIG. 2.

FIG. 2 is a sectional view illustrating a configuration around a photoconductive drum 311 included in the printer unit 300. As illustrated in FIG. 2, the printer unit 300 includes a light emitting device 310, the photoconductive drum 311, a charging roller 312, and a developing roller 313. The printer unit 300 further includes a transfer roller 314 and a cleaning blade 315.

As illustrated in FIG. 2, the charging roller 312, the developing roller 313, and the transfer roller 314 are disposed close to the photoconductive drum 311. The photoconductive drum 311, the charging roller 312, the developing roller 313, and the transfer roller 314 have a length that corresponds to the width of the sheet. In one example of the embodiment, the photoconductive drum 311 is rotated around a rotating shaft passing through the center of the photoconductive drum 311. The photoconductive drum 311 is rotated counterclockwise.

Meanwhile, the charging roller 312, the developing roller 313, and the transfer roller 314 are rotated in a direction opposite to the direction of the photoconductive drum 311.

An image forming unit 306 charges the surface of the photoconductive drum 311 by the charging roller 312. The light emitting device 310 emits light based on the image data. The light emitting device 310 irradiates (exposes) a part on the photoconductive drum 311 at which the electrostatic latent image is to be formed with light, and removes electricity. The developing roller 313 adheres the developer to the electrostatic latent image formed on the photoconductive drum 311. When a sheet 60 is supplied, the transfer roller 314 transfers the visible image formed on the photoconductive drum 311 to the sheet 60. The cleaning blade 315 scrapes unnecessary materials, such as toner remaining on the surface of the photoconductive drum 311 without being transferred to the sheet 60.

Figure 3:
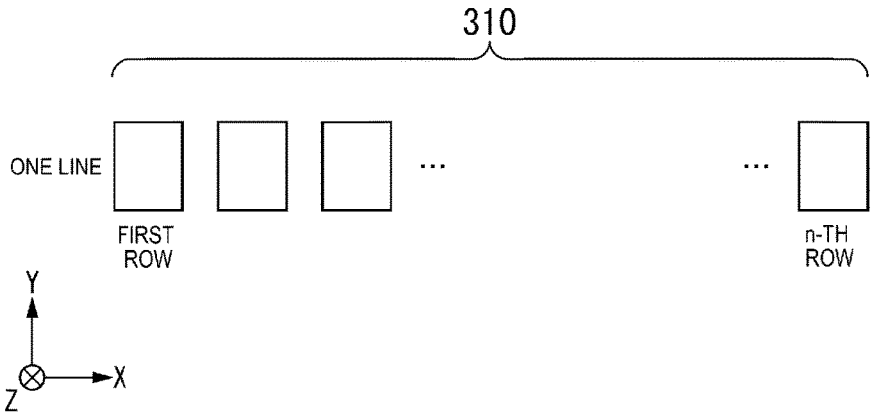
FIG. 3 is a view illustrating an example of disposition of light emitting devices in the embodiment.

FIG. 3 is a view illustrating an example of disposition of the light emitting devices 310 in the embodiment. The printer unit 300 includes the plurality of light emitting elements of the light emitting device 310 for each color. The light emitting device 310 is disposed in a line shape in a direction parallel to the width of the photoconductive drum 311. In addition, the light emitting device 310 may be disposed in a zigzag line shape along a direction parallel to the width direction of the photoconductive drum 311.

Figure 4:
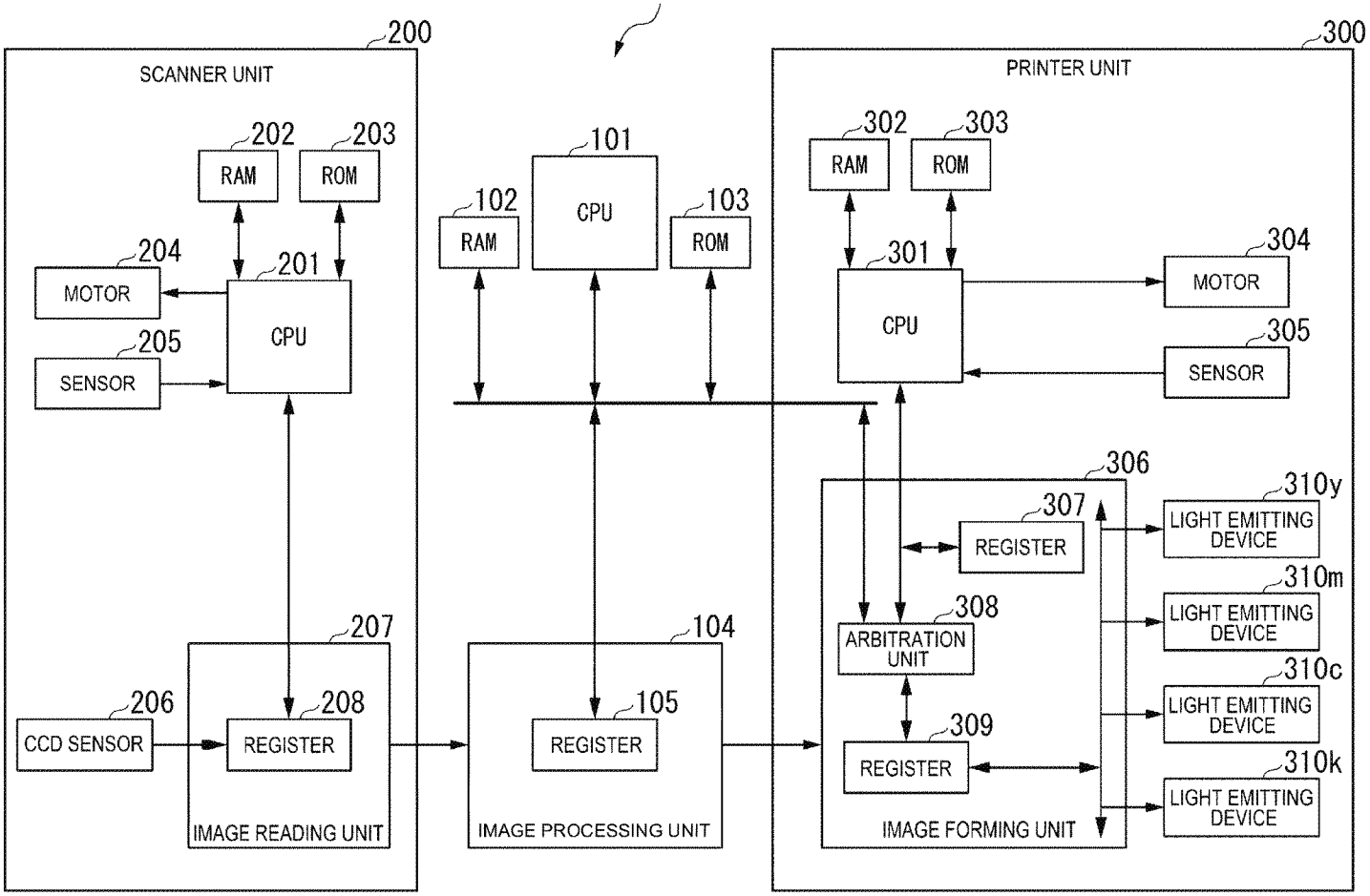
FIG. 4 is a view illustrating an example of a hardware configuration of the image forming apparatus according to the embodiment.

FIG. 4 is a view illustrating an example of a hardware configuration of the image forming apparatus 100 according to the embodiment. The image forming apparatus 100 includes the scanner unit 200, a central processing unit (CPU) 101, and a random access memory (RAM) 102. The image forming apparatus 100 further includes a read only memory (ROM) 103, an image processing unit 104, and a printer unit 300.

The scanner unit 200 includes a CPU 201, a RAM 202, a ROM 203, a motor 204, and a sensor 205. The scanner unit 200 further includes a charge coupled devices (CCD) sensor 206 and an image reading unit 207.

The CPU 201 controls the scanner unit 200. The RAM 202 stores, for example, data used by the CPU 201 for control. The ROM 203 stores, for example, a program used by the CPU 201, data, and the like.

The motor 204 can be various driving sources. The sensor 205 includes, for example, a sensor that detects the setting of an image to be read in a tray. The CCD sensor 206 converts the formed image light into an electric signal and outputs to the image reading unit 207. The image reading unit 207 generates image data based on the signal output from the CCD sensor 206. The image reading unit 207 includes a register 208. The register 208 stores parameters related to control of execution by the image reading unit 207.

In response to the scan instruction, the CPU 201 causes the CCD sensor 206 to read the image to be read. Further, the CPU 201 causes the image reading unit 207 to generate the image data based on the signal output from the CCD sensor 206, and outputs the image data to the image processing unit 104.

Although not illustrated, the scanner unit 200 further includes a scanner lamp, a scanning optical system, a condenser lens, and the like. The scanner lamp illuminates the image to be read. The scanning optical system includes a mirror that changes an optical path of the reflected light from the image to be read. The condensing lens condenses the reflected light from the image to be read and forms an image.

The CPU 101 controls the entire image forming apparatus 100 and performs data processing of imaging. The RAM 102 stores, for example, image data generated by the image reading unit 207, data used for control by the CPU 101, image data on which the imaging was performed, and the like. The ROM 103 stores, for example, a control program used by the CPU 101, a filter used for the imaging, and the like.

The image processing unit 104 performs the imaging of the image data output by the image reading unit 207. Further, the image processing unit 104 performs the imaging of the image data received from a terminal device connected via communication. The imaging includes processing, such as rotation, enlargement, reduction, or filtering of the image data. The image processing unit 104 includes a register 105. The register 105 stores parameters related to the imaging.

The CPU 101 causes the image processing unit 104 to execute the imaging of the image data. Further, the CPU 101 outputs the image data after the imaging to the printer unit 300, and instructs printing.

The printer unit 300 includes a CPU 301, a RAM 302, a ROM 303, a motor 304, a sensor 305, and the image forming unit 306. The printer unit 300 further includes a plurality of light emitting devices 310*y*, 310*m*, 310*c*, and 310*k*.

The light emitting device 310*y* is a light emitting device of yellow "Y". The light emitting device 310*m* is a light emitting device of magenta "M". The light emitting device 310*c* is a light emitting device of cyan "C". The light emitting device 310*k* is a light emitting device of black "K".

In one example of the embodiment, the light emitting device 310*y* includes 15400 light emitting elements. Similarly, the light emitting devices 310 of other colors each include 15400 light emitting elements. Therefore, the light emitting devices 310*y*, 310*m*, 310*c*, and 310*k* include, for example, 61600 (=15400×4) light emitting elements in total. Hereinafter, light emitting devices 310*y*, 310*m*, 310*c*, and 310*k* of each color are also referred to as the light emitting device 310 unless distinction is necessary.

The CPU 301 controls the printer unit 300. The RAM 302 stores, for example, data and the like used for control by the CPU 301. The ROM 303 stores, for example, a program used by the CPU 301, data, and the like. The motor 304 can be various driving sources. The sensor 305 includes various sensors.

The image forming unit 306 includes a register 307, an arbitration unit 308, and a register 309. The register 307 stores parameters related to control of execution by the image forming unit 306.

The register 309 stores parameters of each light emitting element of the light emitting device 310. When an LED or an OLED is used for the light emitting device 310, variations occur in the amount of light emitted between the light emitting elements. Parameters are provided for each light emitting element of the light emitting device 310 in order to control variations in the amount of light emitted. The parameter of the light emitting device 310 is, for example, information indicating light emission intensity or light emission time. By adjusting the parameters, the amount of light emitted from each light emitting element can be made uniform.

For example, when activating the image forming apparatus 100, parameters of all the light emitting elements are read out from a storage device (not illustrated) and written in the register 309. In addition, when deactivating the image forming apparatus 100, parameters are read out from the register 309 and stored in the storage device. The storage device is a device, such as a hard disk drive (HDD) connected to the image forming apparatus 100.

In addition, for example, when executing maintaining for adjusting the amount of light emitted and the like, writing in the register 309, reading out from the register 309, and the like are performed. Accordingly, the parameters of each light emitting element are adjusted or updated.

In response to the print instruction, the CPU 301 causes the image forming unit 306 to execute printing. At this time, the CPU 301 causes the light emitting device 310 to emit the light according to the parameters of the light emitting device 310 stored in the register 309. Accordingly, the photoconductor is exposed and the printing is performed.

Although not illustrated, as described above in FIG. 2, the printer unit 300 includes the photoconductive drum 311, the charging roller 312, and the developing roller 313. In addition, the printer unit 300 further includes the transfer roller 314 and the cleaning blade 315.

As described above in FIG. 4, the CPU 101 controls the entire image forming apparatus 100 and processes data. Meanwhile, the CPU 301 mainly sets or controls the register 307 of the image forming unit 306. In other words, the CPU 301 does not process data.

Therefore, the CPU 301 accesses the register and the like of the image forming unit 306 according to a low-speed interface. For example, the CPU 301 accesses the register in accordance with a serial transfer method. The bit width of data transfer by the CPU 301 is, for example, 1 bit. The clock frequency of the CPU 301 is, for example, 5 MHz, 10 MHz, or the like.

Meanwhile, the CPU 101 that performs the data processing accesses the register and the like using a high-speed interface. For example, the CPU 101 accesses the register in accordance with the parallel transfer method. The bit width of the data transfer of the CPU 101 is, for example, 64 bits, 32 bits, or the like. Further, the clock performance of the CPU 101 that performs the data processing is higher than the clock performance of the CPU 301. The clock frequency of the CPU 101 is, for example, 100 MHz.

As described above, the light emitting device 310 includes 61600 light emitting elements. Therefore, the register 309 stores at least 61600 parameters. The size of each parameter is, for example, 8 bits. Therefore, when the CPU 301 accesses the register 309 in accordance with the low-speed interface, the time required for the accessing becomes long. Accordingly, the time required for activating or deactivating of the image forming apparatus 100 becomes long.

Therefore, in a period in which predetermined processing is performed, the arbitration unit 308 causes the CPU 101, which has faster access speed, to access the register 309. That means, in the period of performing the predetermined processing, the arbitration unit 308 causes the CPU 101 different from the CPU 301 that performs the image forming to execute the accessing. In other words, the register 309 used for the image forming is accessed by the CPU 101 different from the CPU 301 that performs the image forming.

Accordingly, the time required for the accessing in the period of performing the predetermined processing can be shortened. Therefore, in the image forming apparatus 100 using the light emitting device 310, the time required for the predetermined processing can be substantially shortened.

The predetermined processing includes, for example, at least one of the activating, the deactivating, and the maintaining of the image forming apparatus 100. In other words, the predetermined processing is at least one of the writing and the reading out of a large amount of parameters of the light emitting element to and from the register 309.

Figure 5:
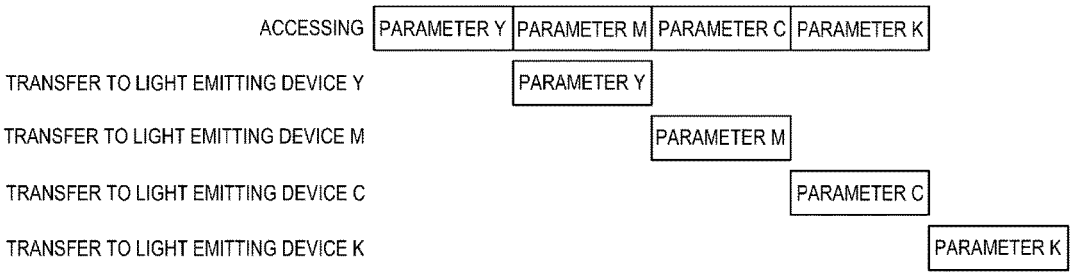
FIG. 5 is a view for describing a processing time when a CPU performs accessing of parameters.
Figure 6:
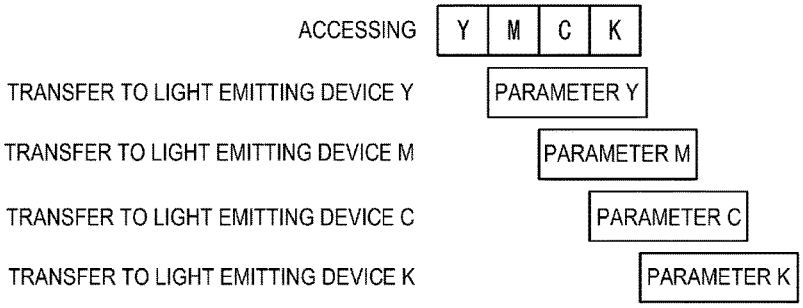
FIG. 6 is a view for describing the processing time when the CPU performs the accessing of the parameters.

Here, according to FIGS. 5 and 6, the processing time when each CPU accesses the parameters will be schematically described. FIGS. 5 and 6 exemplify the processing time when the parameter is written in the register 309 and transferred to the light emitting device 310.

FIG. 5 is a view for describing the processing time when the CPU 301 performs the accessing of the parameters. As illustrated in FIG. 5, the CPU 301 reads out a parameter group of each color (YMCK) from the storage device, and sequentially writes the parameters in the register 309. When the writing in the register 309 is completed, the CPU 301 transfers the parameter group written in the register 309 to each light emitting device 310.

Specifically, the CPU 301 writes the parameter group of the light emitting device 310*y* of "Y" in the register 309. After the writing of the parameter group of "Y" is completed, the CPU 301 writes the parameter group of the light emitting device 310*m* of "M" in the register 309. In addition, the CPU 301 transfers the parameter group of "Y" written in the register 309 to the light emitting device 310*y*.

Similarly, the CPU 301 writes the parameter group of "C" and "K" in the register 309. The CPU 301 transfers the parameter group of "M", "C", and "K" written in the register 309 to the corresponding light emitting device 310.

FIG. 6 is a view for describing the processing time when the CPU 101 performs the accessing of the parameters. As described above, the transfer speed of the interface used by the CPU 101 is higher than the interface used by the CPU 301. Further, the clock performance of the CPU 101 is higher than the clock performance of the CPU 301. Therefore, the CPU 101 can access the register 309 at higher speed than the CPU 301.

Therefore, as illustrated in FIG. 6, the time taken for the writing of the parameter group of each color in the register 309 is substantially shortened compared to FIG. 5. In FIG. 6, the timing at which the writing of the parameter group in the register 309 is completed is earlier than the timing of FIG. 5. Therefore, the CPU 101 can transfer the parameter group written in the register 309 to the light emitting device 310 at an earlier timing.

Here, according to FIG. 7, the hardware configuration of the arbitration unit 308 will be described. In addition, the processing flow of the arbitration unit 308 will be described in accordance with the flowchart of FIG. 8.

Figure 7:
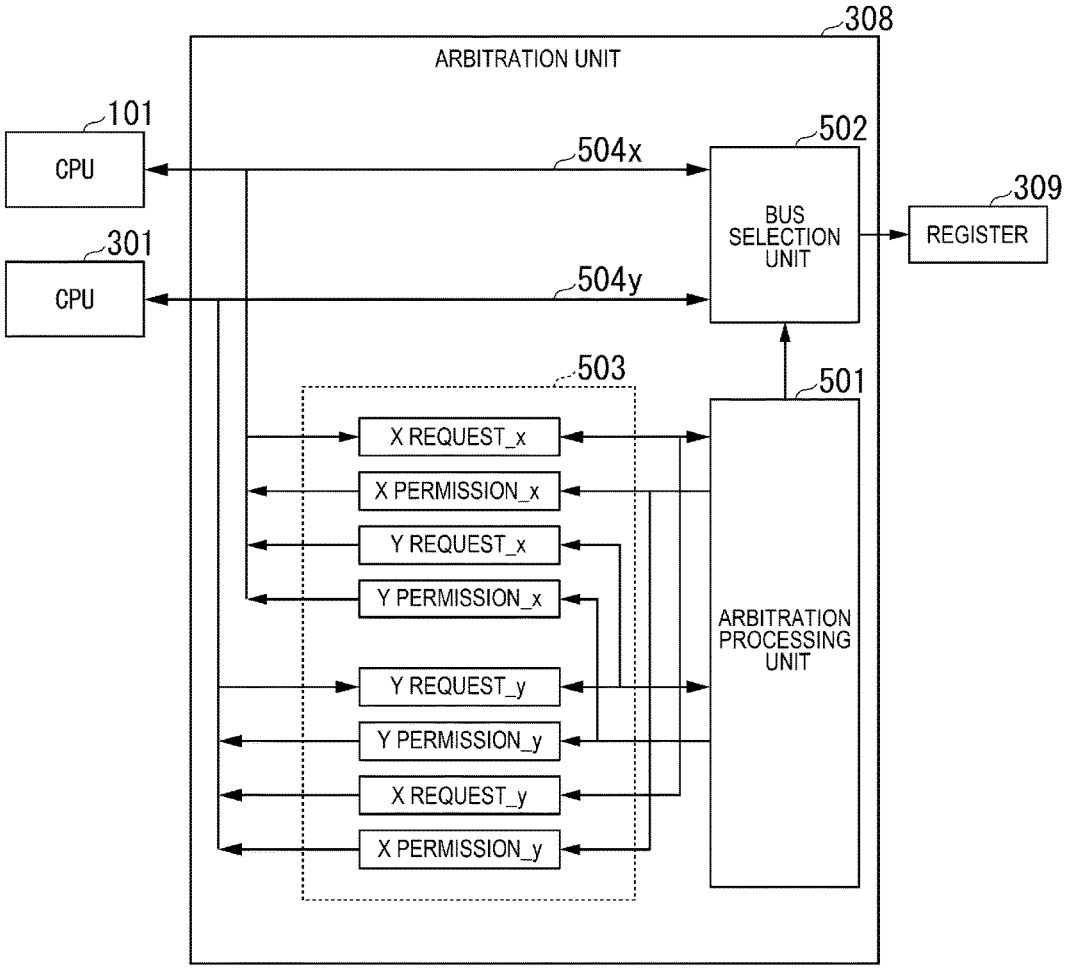
FIG. 7 is a view illustrating an example of a hardware configuration of an arbitration unit in the embodiment.

FIG. 7 is a view illustrating an example of the hardware configuration of the arbitration unit 308 in the embodiment. The arbitration unit 308 is configured by an electronic circuit.

The arbitration unit 308 includes an arbitration processing unit 501, a bus selection unit 502, a plurality of registers 503, and buses 504*x* and 504*y*. The bus 504*x* is connected to the CPU 101, and 504*y* is connected to the CPU 301. Hereinafter, the buses 504*x* and 504*y* are also referred to as the bus 504 unless distinction is necessary.

The plurality of registers 503 include the register group accessed by the CPU 101 and the register group accessed by the CPU 301. The register group accessed by the CPU 101 is registers "X request_x", "X permission_x", "Y request_x", and "Y permission_x". Among these, the registers "X request_x" and "X permission_x" indicate the access status to the register 309 by the CPU 101. Meanwhile, the registers "Y request_x" and "Y permission_x" indicate the access status to the register 309 by the CPU 301.

Meanwhile, the register group accessed by the CPU 301 is registers "Y request_y", "Y permission_y", "X request_y", and "X permission_y". Among these, the registers "Y request_y" and "Y permission_y" indicate the access status to the register 309 by the CPU 301. Meanwhile, the registers "X request_y" and "X permission_y" indicate the access status to the register 309 by the CPU 101.

Here, the registers "X request_x", "X permission_x", "Y request_x", and "Y permission_x" accessed by the CPU 101 will be described in detail.

The register "X request_x" holds information indicating the presence or absence of an access request to the register 309 by the CPU 101. The register "X request_x" has, for example, a value "1" when there is an access request, and a value "0" when there is no access request. The register "X permission_x" holds information indicating the presence or absence of permission for the access request. The register "X permission_x" has, for example, a value "1" when there is permission for the access request, and a value "0" when there is no permission.

When accessing the register 309, the CPU 101 sets the access request to the register "X request_x". In other words, the CPU 101 sets the value "1" in the register "X request_x". When the value "1" is set in the register "X request_x", the arbitration processing unit 501 updates the register "X permission_x" in accordance with the access status of the CPU 301. Specifically, when the accessing by the CPU 301 is not being executed, the arbitration processing unit 501 sets the value "1" in the register "X permission_x".

When accessing the register 309 is completed, the CPU 101 withdraws the access request. In other words, the CPU 101 sets the value "0" in the register "X request_x". When the access request from the CPU 101 is withdrawn, the arbitration processing unit 501 sets the value "0" in the register "X permission_x".

The register "Y request_x" holds information indicating the presence or absence of an access request to the register 309 by the CPU 301. The register "Y request_x" has, for example, a value "1" when there is an access request, and a value "0" when there is no access request. The register "Y permission_x" holds information indicating the presence or absence of permission for the access request. The register "Y permission_x" has, for example, a value "1" when there is permission for the access request, and a value "0" when there is no permission.

The arbitration processing unit 501 sets the values in the registers "Y request_x" and "Y permission_x" in accordance with the presence or absence of the access request by the CPU 301 and the presence or absence of permission. By referring to the values of the registers "Y request_x" and "Y permission_x", the CPU 101 can determine the access status by the CPU 301.

Next, the registers "Y request_y", "Y permission_y", "X request_y", and "X permission_y" accessed by the CPU 301 will be described in detail.

The register "Y request_y" holds information indicating the presence or absence of an access request to the register 309 by the CPU 301. The register "Y request_y" has, for example, a value "1" when there is an access request, and a value "0" when there is no access request. The register "Y permission_y" holds information indicating the presence or absence of permission for the access request. The register "Y permission_y" has, for example, a value "1" when there is permission for the access request, and a value "0" when there is no permission.

When accessing the register 309, the CPU 301 sets the access request to the register "Y request_y". In other words, the CPU 301 sets the value "1" in the register "Y request y".

When the value "1" is set in the register "Y request_y", the arbitration processing unit 501 updates the register "Y permission_y" in accordance with the access status of the CPU 101. Specifically, when the accessing by the CPU 101 is not being executed, the arbitration processing unit 501 sets the value "1" in the register "Y permission_y".

When accessing the register 309 is completed, the CPU 301 withdraws the access request. In other words, the CPU 301 sets the value "0" in the register "Y request_y". When the access request from the CPU 301 is withdrawn, the arbitration processing unit 501 sets the value "0" in the register "Y permission_y".

The register "X request_y" holds information indicating the presence or absence of an access request to the register 309 by the CPU 101. The register "X request_y" has, for example, a value "1" when there is an access request, and a value "0" when there is no access request. The register "X permission_y" holds information indicating the presence or absence of permission for the access request. The register "X permission_y" has, for example, a value "1" when there is permission for the access request, and a value "0" when there is no permission.

The arbitration processing unit 501 sets the values in the registers "X request_y" and "X permission_y" in accordance with the presence or absence of the access request by the CPU 101 and the presence or absence of permission. By referring to the values of the registers "X request_y" and "X permission_y", the CPU 301 can determine the access status by the CPU 101.

For example, the arbitration processing unit 501 outputs the identification information of the CPU permitted to the access request to the bus selection unit 502. The bus selection unit 502 selects the buses 504*x* and 504*y* based on the identification information of the CPU. The CPU that corresponds to the selected bus 504 accesses the register 309 via the bus 504.

Figure 8:
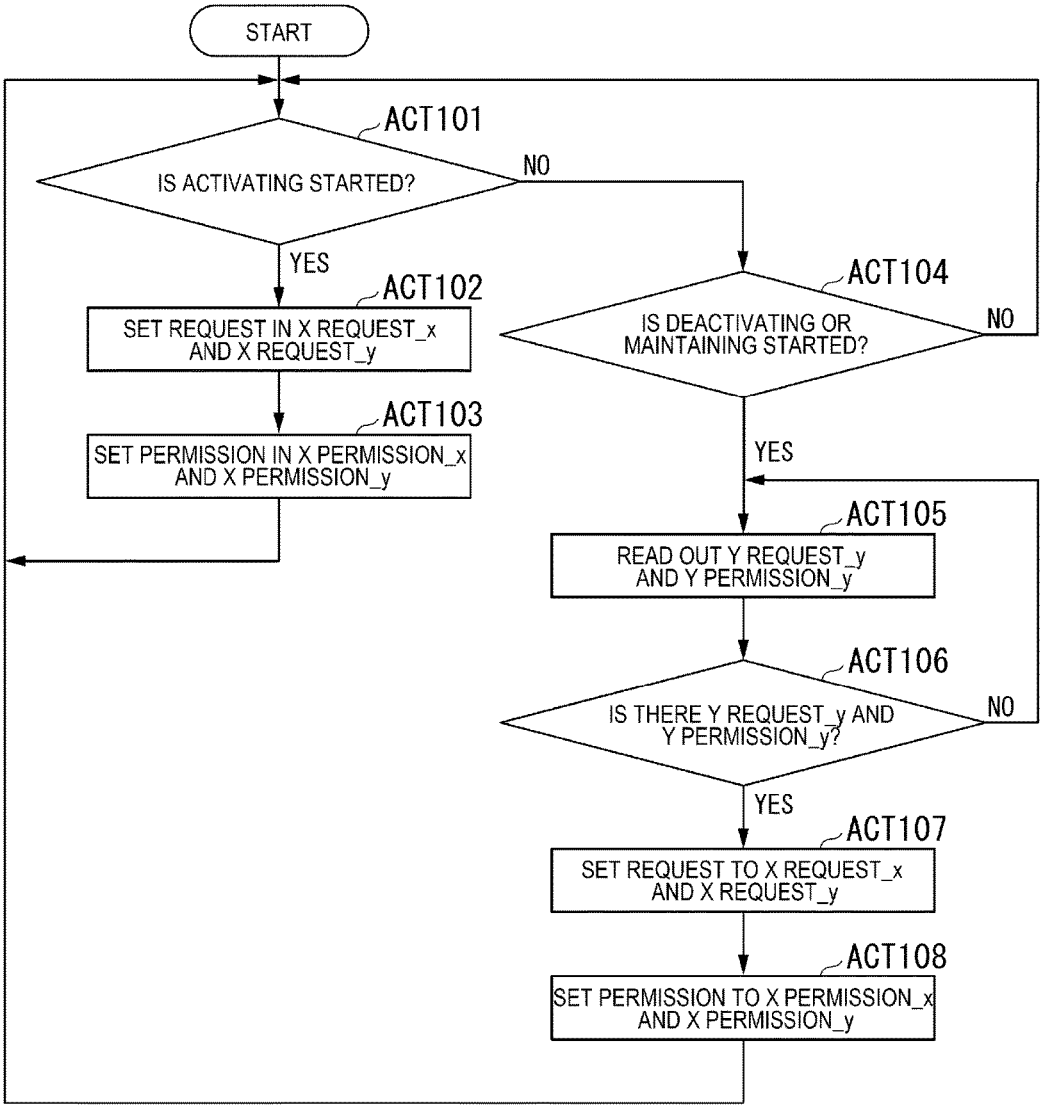
FIG. 8 is a view illustrating a flowchart for describing control by an arbitration processing unit.

FIG. 8 is a view illustrating a flowchart for describing control by the arbitration processing unit 501. The arbitration processing unit 501 determines whether or not the activating of the image forming apparatus 100 started (ACT 101). For example, the CPU 101 detects an activation event and notifies the arbitration processing unit 501. Based on the notification from the CPU 101, the arbitration processing unit 501 detects whether or not the activating is started.

When the activating is started (YES in ACT 101), the arbitration processing unit 501 sets a request in the registers "X request_x" and "X request_y" (ACT 102). In addition, the arbitration processing unit 501 sets permission present for the registers "X permission_x" and "X permission_y" (ACT 103). Accordingly, the access request is set by the CPU 101 and the access request is permitted. In this manner, the arbitration processing unit 501 controls the CPU 101 to perform the accessing during the activating period.

Meanwhile, when the activating is not started (NO in ACT 101), the arbitration processing unit 501 further performs the following determination. In other words, the arbitration processing unit 501 determines whether or not any of the deactivating or the maintaining of the image forming apparatus 100 started (ACT 104). The CPU 101 detects a deactivation event or a maintenance event and notifies the arbitration processing unit 501. Based on the notification from the CPU 101, the arbitration processing unit 501 detects whether or not the deactivating or the maintaining is started.

When the deactivating or the maintaining is started (YES in ACT 104), the arbitration processing unit 501 acquires the access status by the CPU 301. In other words, the arbitration processing unit 501 reads out the values of the registers "Y request_y" and "Y permission_ y" (ACT 105). The arbitration processing unit 501 determines whether or not there is request in the register "Y request_y" and whether or not there is permission in the register "Y permission_y" (ACT 106). When ACT 106 is NO, the accessing by the CPU 301 is being executed. Therefore, the arbitration processing unit 501 repeats the processes ACT 105 and the ACT 106 until the accessing by the CPU 301 is completed.

Meanwhile, when process ACT 106 is YES, the accessing by the CPU 301 is not being executed. Therefore, the arbitration processing unit 501 sets that there is the request to the registers "X request_x" and "X request_y" (ACT 107). In addition, the arbitration processing unit 501 sets that there is the permission for the registers "X permission_x" and "X permission_y" (ACT 108). Accordingly, the access request is set by the CPU 101 and the access request is permitted.

In this manner, the arbitration processing unit 501 controls the CPU 101 to perform the accessing during the deactivating and maintaining period. Meanwhile, the arbitration processing unit 501 controls the CPU 301 to perform the accessing during the period that does not correspond to any of the activating, the deactivating, and the maintaining.

Figure 9:
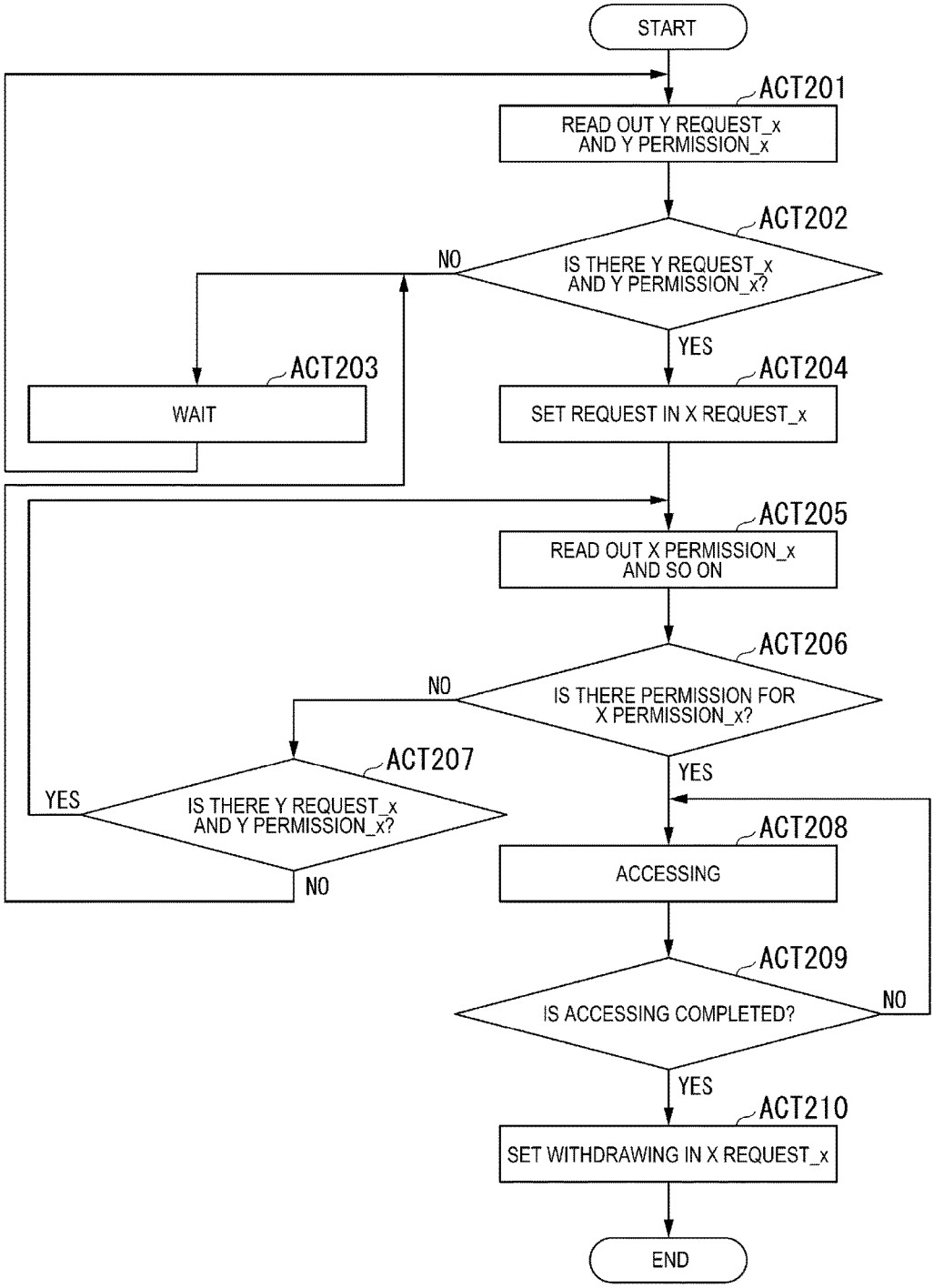
FIG. 9 is a view illustrating a flowchart for describing control of the CPU.

FIG. 9 is a view illustrating a flowchart for describing control of the CPU 101. The CPU 101 reads out the values of the registers "Y request_x" and "Y permission_x" (ACT 201) and acquires the access status to the register 309 by the CPU 301.

The CPU 101 determines whether or not the accessing by the CPU 301 is being executed (ACT 202). Specifically, the CPU 101 determines whether or not it is indicated that the register "Y request_x" is not requested and the register "Y permission_x" is not permitted. When the register y request_x" is not requested and the register "Y permission_x" is not permitted, the accessing by the CPU 301 is not being executed.

When the accessing by the CPU 301 is being executed (NO in ACT 202), the CPU 101 waits for the processing (ACT 203). After the waiting, the CPU 101 executes the process ACT 201 again. Until the accessing by the CPU 301 is completed (YES in ACT 202), The CPU 101 repeats the processes from ACT 201 to ACT 203.

Meanwhile, when the accessing by the CPU 301 is not being executed (YES in ACT 202), the CPU 101 performs the following process. In other words, the CPU 101 sets an access request to the register "X request_x" (ACT 204). After setting the access request, the CPU 101 reads out the values of the registers "X permission_x", "Y request_x", and "Y permission_x" (ACT 205).

The CPU 101 determines whether or not the register "X permission_x" indicates that there is the permission (ACT 206). In other words, the CPU 101 determines whether or not the set access request is permitted.

When the register "X permission_x" indicates that there is no permission (NO in ACT 206), the access request is not permitted yet. It means, for example, the accessing by the CPU 301 occurred immediately before the access request by the CPU 101 is set. Similar to the process ACT 202, the CPU 101 determines whether or not the accessing by the CPU 301 is being executed (ACT 207).

When the accessing by the CPU 301 is being executed (NO in ACT 207), the CPU 101 waits for the processing (ACT 203). The process after the waiting is as described above.

Meanwhile, when the accessing by the CPU 301 is not being executed (YES in ACT 207), the processes ACT 205 and ACT 206 are executed. In other words, the CPU 101 determines whether or not the access request is permitted again. The CPU 101 repeats the processes from ACT 205 to ACT 207 until the access request is permitted.

When the access request is permitted (YES in ACT 206), the CPU 101 accesses the register 309 (ACT 208). For example, the CPU 101 writes each parameter in the register 309 and reads out each parameter from the register 309. The CPU 101 determines whether or not the accessing is completed (ACT 209).

When the accessing is completed (YES in ACT 209), the CPU 101 withdraws the request of the register "X request_x" (ACT 210). When the access request is withdrawn, the arbitration processing unit 501 further sets the register "X request_y" to no request. In addition, the arbitration processing unit 501 sets the registers "X permission_x" and "X permission_y" to no permission.

Figure 10:
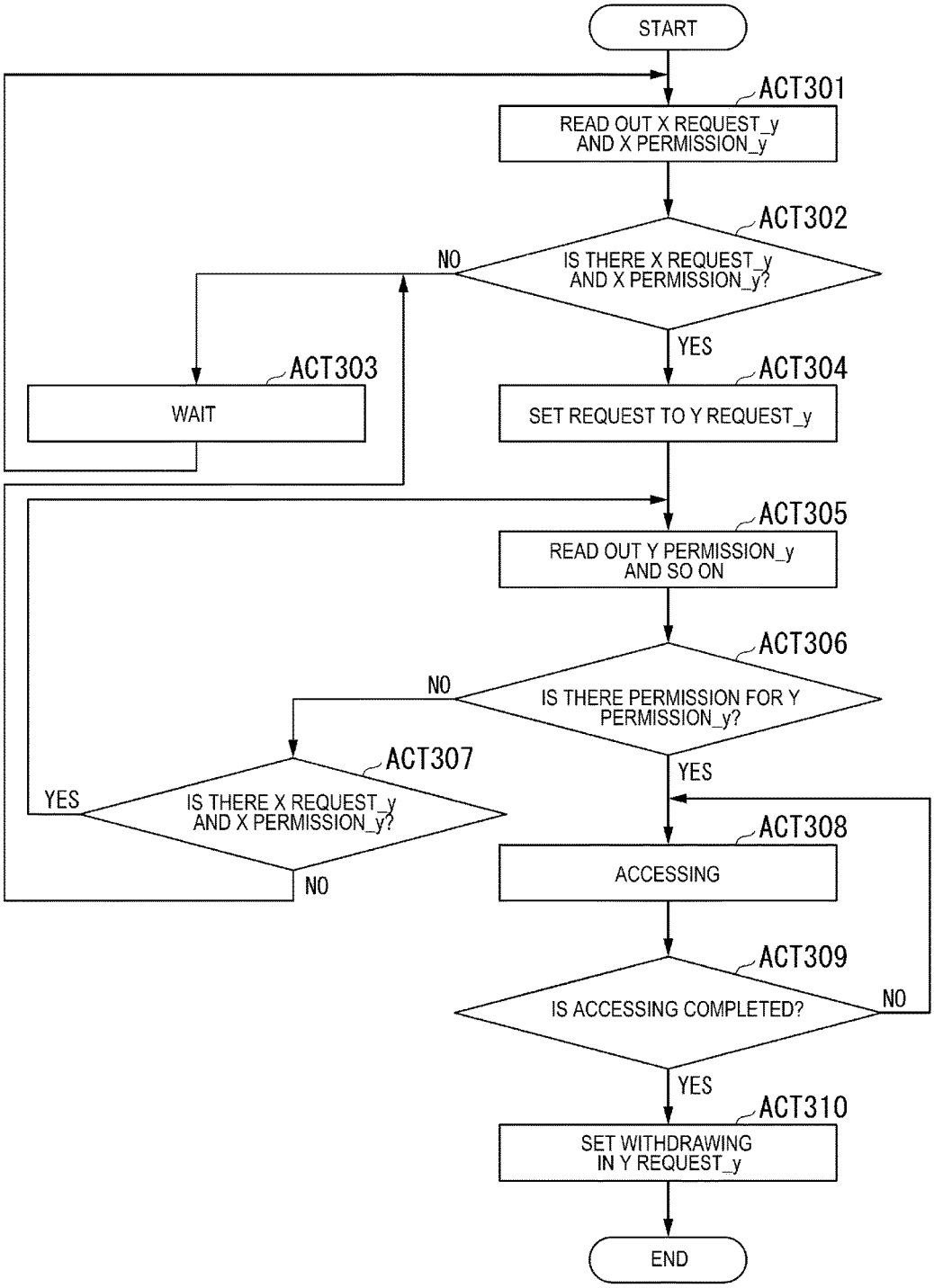
FIG. 10 is a view illustrating a flowchart for describing the control of the CPU.

FIG. 10 is a view illustrating a flowchart for describing control of the CPU 301. The CPU 301 reads out the values of the registers "X request_y" and "X permission_y" (ACT 301) and acquires the access status to the register 309 by the CPU 101.

The CPU 301 determines whether or not the accessing by the CPU 101 is being executed (ACT 302). Specifically, the CPU 301 determines whether or not it is indicated that the register "X request_y" is not requested and the register "X permission_y" is not permitted. When the register "X request_y" is not requested and the register "X permission_y" is not permitted, the accessing by the CPU 101 is not being executed.

When the accessing by the CPU 101 is being executed (NO in ACT 302), the CPU 301 waits for the processing (ACT 303). After the waiting, the CPU 301 executes the process ACT 301 again. Until the accessing by the CPU 101 is completed (YES in ACT 302), The CPU 301 repeats the processes from ACT 301 to ACT 303.

Meanwhile, when the accessing by the CPU 101 is not being executed (YES in ACT 302), the CPU 301 performs the following process. In other words, the CPU 301 sets an access request to the register "Y request_y" (ACT 304). After setting the access request, the CPU 301 reads out the values of the registers "Y permission_y", "X request_y", and "X permission_y" (ACT 305).

The CPU 301 determines whether or not the register "Y permission_y" indicates that there is the permission (ACT 306). In other words, the CPU 301 determines whether or not the set access request is permitted.

When the register "Y permission_y" indicates that there is no permission (NO in ACT 306), the access request is not permitted yet. It means, for example, the accessing by the CPU 101 occurred immediately before the access request by the CPU 301 is set. Similar to the process ACT 302, the CPU 301 determines whether or not the accessing by the CPU 101 is being executed again (ACT 307).

When the accessing by the CPU 101 is being executed (NO in ACT 307), the CPU 301 waits for the processing (ACT 303). The processing after the waiting is as described above.

Meanwhile, when the accessing by the CPU 101 is not being executed (YES in ACT 307), the processes ACT 305 and ACT 306 are executed. In other words, the CPU 301 determines whether or not the access request is permitted again. The CPU 301 repeats the processes from ACT 305 to ACT 307 until the access request is permitted.

When the access request is permitted (YES in ACT 306), the CPU 301 accesses the register 309 (ACT 308). For example, the CPU 301 writes each parameter in the register 309 and reads out each parameter from the register 309. The CPU 301 determines whether or not the accessing is completed (ACT 309).

When the accessing is completed (YES in ACT 309), the CPU 301 withdraws the request of the register "Y request_y" (ACT 310). When the access request is withdrawn, the arbitration processing unit 501 further sets the register "Y request_x" to no request. In addition, the arbitration processing unit 501 sets the registers "Y permission_x" and "Y permission_y" to no permission.

As described in FIGS. 8 to 10, the arbitration unit 308 arbitrates the accessing by each CPU by updating the register. Accordingly, arbitration can be realized by a simple circuit without a complicated circuit. Further, complicated processing between the CPU 101 and the CPU 301 can be omitted.

Specifically, the arbitration unit 308 updates the register so as to permit the CPU 101 to access the register 309 during a period of performing the predetermined processing. Accordingly, during the period of performing the predetermined processing, it is possible to control the CPU 101 to perform the accessing. Meanwhile, during the period other than the period of performing the predetermined processing, it is possible to control the CPU 301 to perform the accessing.

The above-described image forming apparatus 100 of the embodiment includes the storage unit 309, the first processor 301, the second processor 101, and the arbitration unit 308. The storage unit 309 stores control information related to the control of light emission of each of the plurality of light emitting elements that irradiate the photoconductor with light. The first processor 301 accesses the storage unit 309. The second processor 101 accesses the storage unit 309 and accesses faster than the first processor 301. The arbitration unit 308 controls the second processor 101 to perform the accessing with respect to the storage unit in a first period during which predetermined processing is performed. In the second period other than the first period, the arbitration unit 308 controls the first processor 301 to perform the accessing.

In this manner, the arbitration unit 308 switches the processor that accesses the storage unit 309 during the period of performing the predetermined processing. In other words, the arbitration unit 308 causes the second processor 101 which performs the accessing faster, to execute the accessing during the period of performing the predetermined processing. The storage unit 309 used for the image forming is accessed by the second processor 101 different from the first processor 301 that performs the image forming.

Accordingly, the time required for the accessing in the period of performing the predetermined processing is substantially shortened. Therefore, in the image forming apparatus 100 using the light emitting device 310, the time required for the predetermined processing can be shortened.

In addition, the predetermined processing in the embodiment includes, for example, at least one of the activating, the deactivating, and the maintaining of the image forming apparatus 100. Accordingly, the time required for the activating, the deactivating, or the maintaining, in which the accessing of a large amount of parameters is performed, can be substantially shortened.

Alternatively, the predetermined processing includes at least one of the writing of the control information to the storage unit 309 and the reading out of the control information from the storage unit 309 with respect to the plurality of light emitting elements. Accordingly, the time required for the processing of performing the accessing of the large amount of parameters is substantially shortened.

In addition, in the embodiment, the second processor 101 is a processor that executes the imaging of the image data. The second processor 101 that performs the imaging has a higher transfer speed and a higher processing ability by processing data. Therefore, the time required for the accessing can be shortened.

In addition, the second processor 101 is not limited to a processor that executes the imaging of the image data. The second processor 101 may be a processor that performs any processing as long as the second processor 101 is a processor having higher access speed compared to the first processor 301.

In addition, the first processor 301 in the embodiment is a processor that executes the control related to the image formation of the image data. In other words, the first processor 301 is a processor that mainly performs the control.

Therefore, in the first period, as the second processor 101 that processes data is caused to perform the accessing, it is possible to reduce the processing time.

While several embodiments of the exemplary embodiment have been described, the embodiments have been presented as an example and are not intended to limit the scope of the exemplary embodiment. The embodiments can be implemented in other various aspects, and various omissions, substitutions, and changes can be made without departing from the gist of the exemplary embodiment. The embodiments or modifications thereof are included in the scope and gist of the exemplary embodiment, as well as within the scope of the exemplary embodiment described in the claims and their equivalents.

What is claimed is:

1. An image forming apparatus comprising:

a storage unit configured to store control information related to at least one parameter of light emission of each of a plurality of light emitting elements that irradiate a photoconductor with light;

a first processor that accesses the storage unit;

a second processor that accesses the storage unit that accesses faster than the first processor; and an arbitration unit configured to control the second processor to access the storage unit in a first period during which predetermined processing is performed, and control the first processor to access in a second period other than the first period.

2. The apparatus according to claim 1, wherein the predetermined processing comprises at least one of activating of the image forming apparatus, deactivating of the image forming apparatus, and maintaining of the image forming apparatus.

3. The apparatus according to claim 1, wherein
the predetermined processing comprises at least one of writing of the control information to the storage unit or reading out of the control information from the storage unit with respect to the plurality of light emitting elements.

4. The apparatus according to claim 1, wherein
the second processor executes imaging of image data.

5. The apparatus according to claim 1, wherein
the first processor executes control related to image formation of image data.

6. The apparatus according to claim 5, wherein
the second period includes a period during which the control related to the image formation is executed.

7. The apparatus according to claim 1, wherein
the light emission of the plurality of light emitting elements is controlled based on the control information stored in the storage unit.

8. The apparatus according to claim 1, wherein
the plurality of light emitting elements comprise a plurality of light emitting elements for each of a plurality of colors.

9. The apparatus according to claim 1, wherein
the arbitration unit comprises:
a register that stores permission information indicating whether or not the access by the second processor is permitted; and
a control unit configured to control the second processor to access when the permission information held by the register indicates permission, and
the control unit causes the register to hold the permission information indicating permission during the first period.

10. The apparatus according to claim 1, wherein
the at least one parameter of light emission of each of a plurality of light emitting elements is an amount of light emitted therefrom.

11. A control method of an image forming apparatus comprising:
controlling a second processor, which is faster than a first processor in accessing, to access a storage unit storing control information related to at least one parameter of light emission of each of a plurality of light emitting elements that irradiate a photoconductor with light in a first period during which predetermined processing is performed, and
controlling the first processor to access the storage unit in a second period other than the first period.

12. The method according to claim 11, wherein
predetermined processing comprises at least one of:
activating of the image forming apparatus,
deactivating of the image forming apparatus, and
maintaining of the image forming apparatus.

13. The method according to claim 11, wherein
predetermined processing comprises at least one of:
writing of the control information to the storage unit, or
reading out of the control information from the storage unit with respect to the plurality of light emitting elements.

14. The method according to claim 11, further comprising:
imaging image data.

15. The method according to claim 11, further comprising:
controlling image formation of image data by the first processor.

16. The method according to claim 15, further comprising:
controlling the image formation in a period during the second period.

17. The method according to claim 11, further comprising:
controlling the light emission of the plurality of light emitting elements based on the control information stored in the storage unit.

18. The method according to claim 11, wherein
the plurality of light emitting elements comprise a plurality of light emitting elements for each of a plurality of colors.

19. The method according to claim 11, further comprising:
storing permission information indicating whether or not the accessing by the second processor is permitted; and
controlling the second processor to access when the permission information held indicates permission, and
causing a register to hold the permission information indicating permission during the first period.

20. The method according to claim 11, wherein
the at least one parameter of light emission of each of a plurality of light emitting elements is an amount of light emitted therefrom.

* * * * *